United States Patent [19]

Juergens

[11] 4,265,323

[45] May 5, 1981

[54] DIRECT BIT DRIVE FOR DEEP DRILLING TOOLS

[75] Inventor: Rainer Juergens, Altencelle, Fed. Rep. of Germany

[73] Assignee: Christensen, Inc., Salt Lake City, Utah

[21] Appl. No.: 75,352

[22] Filed: Sep. 13, 1979

[51] Int. Cl.[3] ..... E21B 4/02

[52] U.S. Cl. ..... 175/107; 415/502; 418/48

[58] Field of Search ..... 175/107; 415/502; 418/48; 173/73, 79

[56] References Cited

U.S. PATENT DOCUMENTS

| | | | |
|---|---|---|---|
| 2,329,386 | 9/1943 | Brennan | 418/48 |
| 2,591,488 | 4/1952 | Yost | 175/107 X |
| 3,203,350 | 8/1965 | Chang | 418/48 |
| 3,982,858 | 9/1976 | Tschirky | 175/107 |

FOREIGN PATENT DOCUMENTS

| | | | |
|---|---|---|---|
| 425447 | 3/1935 | United Kingdom | 418/48 |

*Primary Examiner*—Ernest R. Purser
*Attorney, Agent, or Firm*—Frank S. Chow

[57] ABSTRACT

The present invention relates to a direct bit drive for deep drilling tools based on the Moineau principles. The drive is divided into two sections disposed end-to-end and co-axially in line, each with a defined helical working space between surfaces shaped in a manner of helical teeth, the said helical working spaces following oppositely turning helical paths and being arranged for the flow therethrough of the working medium, in axially opposite directions. In this manner, the axially thrust forces transmitted to the bit through the direct bit drive by working medium during a drilling operation are reduced.

20 Claims, 6 Drawing Figures

DIRECT BIT DRIVE FOR DEEP DRILLING TOOLS

BACKGROUND OF THE INVENTION

The invention relates to a direct bit drive for deep drilling tools.

It is known to provide a direct bit drive for deep drilling tools comprising a housing having an inlet end and an outlet end, a rotor disposed in said housing for rotation therein and for limited radial enlargement but not for axial displacement, said rotor and said housing interengaging at surfaces shaped in the manner of helical teeth, said shaped surfaces jointly defining at least one helical working space for a liquid or gaseous working medium, one of said shaped surfaces being formed on a shaped member of resiliently deformable material, and bearing in regions which move axially, upon relative rotary movement between said housing and said rotor, under pressure, with a sealing action, against the other shaped surface, which is of rigid construction, said shaped member of resiliently deformable material being arranged to be acted upon by the pressure of a pressure medium in a pressure chamber with radially directed deformation forces which alter, depending on the pressure prevailing in the working medium at the inlet side of said housing, and wherein said rotor comprises a shaft which acts as a carrier for the shaped member of resiliently deformable material, said shaped member of resiliently deformable material being disposed on the shaft and being constructed in the form of a diaphragm member which is located at its two ends on the shaft and is freely displaceable radially in its intermediate region, relative to the shaft, and which, at its inside, during its radial displacement movements, is in positive guiding engagement with formations of the shaft and can be acted upon by the pressure of a pressure medium in a pressure chamber formed between the shaped member of resiliently deformable material and the shaft with said radially directed deformation forces.

Such a direct bit drive forms the subject of an earlier proposal. By the earlier proposal, a direct bit drive based on the Moineau principle is provided for deep drilling tools, wherein the contact pressure which determines the sealing action between the regions of the shaped surfaces which are in engagement can be adapted to the pressure and temperature conditions of the working medium and can be adapted so that under all operating conditions, the required sealing is retained and on the other hand the wear is reduced to a minimum extent. Wear phenomena are immediately compensated for by the resilient expansion of the shaped member. Apart from this, as a result of its association with the shaft as the inner component, the shaped member forms a relatively simple wearing part which can easily be replaced if necessary. The deformation of the shaped member, which is made radially variable as a whole in practice, is very precise in all regions in operation of the direct bit drive according to the earlier proposal, and is uniform, with simultaneous securing of a satisfactory transmission of torque between shaped member and shaft over their length and periphery. The adaptation which can be effected in operation ensures not only a running of the direct bit drive under optimum working conditions but also eliminates the necessity of providing a multiplicity of types of machines of different design in order to make allowance for the particular operating requirements. In addition, high performances can be achieved with the direct bit drive according to the earlier proposal, with a considerably reduced structural size and correspondingly reduced costs, because even with a construction with single-thread helical teeth of housing and shaft, that is to say of stator and rotor, pressure differences between inlet and outlet of the working chamber of the order of magnitude of 120 bar and more can be achieved with a high volumetric efficiency. When the direct bit drive according to the earlier proposal is used under normal drilling conditions, this can be constructed for example with nine-thread helical teeth, in a length of about 1 m, and such a drive delivers a considerably higher torque than conventional direct bit drives which have a structural length of about 3 to 4 m for normal drilling conditions.

The object of the invention is to provide a direct bit drive of the kind indicated which has a long life of its axial bearings when designed for high performances.

SUMMARY OF THE INVENTION

According to the invention, this problem is solved in that the drive is divided into two sections disposed end-to-end and co-axially in line, each with a helical working space defined as aforesaid between surfaces shaped in the manner of helical teeth, the said helical working spaces following oppositely turning helical paths and being arranged for the flow therethrough of the working medium, in axially opposite directions.

The construction according to the invention renders it possible for the axial thrust forces transmitted to the bit through the direct bit drive by the working medium in a drilling operation to be reduced by a partial equalisation of such forces or to be completely cancelled out, and as a result of the opposite helical teeth of the shaped surfaces of the two helical working spaces, the rotation and delivery of torque are equal to those of an undivided drive. As a result of this construction, the universal joint shaft following on the two drive sections for the transmission of torque to the bit and in particular also the axial thrust bearings of the bearing block of the drive are relieved of the high axial thrust forces which, in the prior art construction, appear in only the downwardly directed flow direction of the working medium through the drive. Using the invention therefore, a long life of these components previously subjected to high axial thrust forces is assured.

Numerous further features and advantages of the invention are apparent from the claims and the following description in connection with the accompanying drawings in which several embodiments of the invention are illustrated in more detail by way of example only and not by way of limitation.

DESCRIPTION OF THE PREFERRED EMBODIMENTS

Figure 1A:
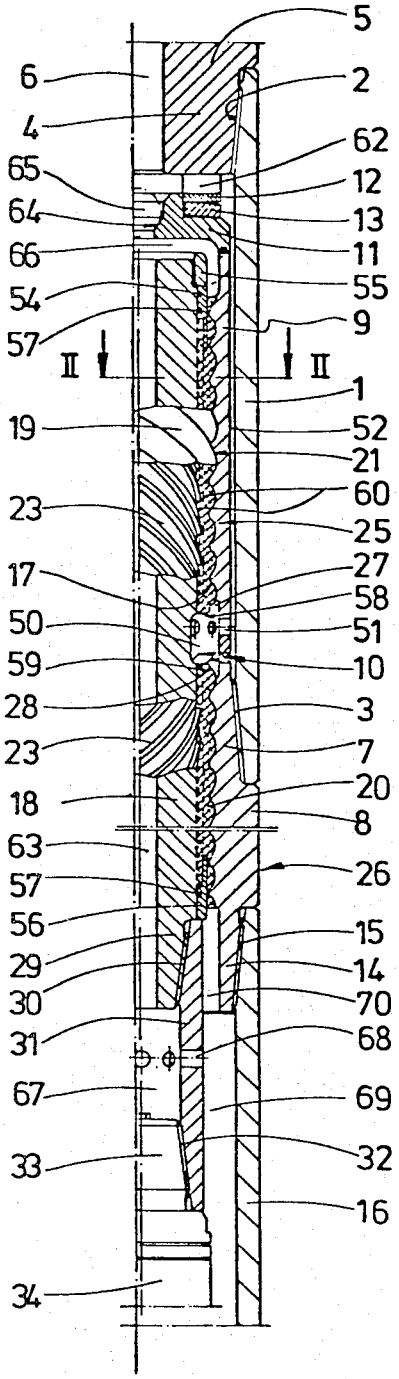
FIGS. 1*a* and 1*b* show a quarter longitudinal section through a first embodiment of a direct bit drive according to the invention with parts locally illustrated in elevation, including the bearing block and the bit, FIG. 1*b* being the lower extension of FIG. 1*a*.

The direct bit drives illustrated in the drawings comprise, as can first be seen from FIG. 1*a*, an outer tube 1 which has a conical internal thread 2 or 3 at each of its two ends. By means of the upper conical thread 2, the outer tube 1 is screwed to an external thread extension 4 of a length of connecting tube 5 through which the outer tube 1 is connected to a pipe string not illustrated. The tube 5 has a central bore 6 which continues through the length of connecting tube 5 for the supply of flushing medium.

With its lower internal thread 3, the outer tube 1 is screwed to an external thread extension 7 of a lower housing 8 of the direct bit drive which also comprises an upper housing 9 which is rigidly connected to the lower housing 8 by means of a suitable coupling 10, for example a dog clutch. The coupling 10 secures the two housings 8 and 9 of the drive, each forming a stator, against twisting and ensures for them a prescribed angular position in relation to one another.

At its upper end, the upper housing is located by means of an annular flange 11 which is urged against the end of the upper housing 9 by an external thread extension of the connecting tube 5 through an intermediate ring 12 and a spring washer 13. The lower housing 8 is provided at its lower end with an external thread extension 14 to which a conical internal thread 15 at the end of a lower outer tube 16 is screwed.

Each housing 8, 9 affords at its inside a shaped surface 17 which is formed from the material of the housing, and which may be provided with a suitable surface coating to reduce wear and to prevent corrosion. The concrete shape of the shaped surface 17 is defined by screw threads as explained in detail by the earlier proposal mentioned at the beginning of this specification.

Extending through the housings 8, 9 is a shaft 18 of steel or the like which carries two resilient shaped members 19 and 20 of an axial length which corresponds to the axial length of the shaped surface region of the upper housing 9 and the lower housing 8 of the drive respectively.

The resilient shaped members 19, 20, the construction of which is explained in detail by the earlier proposal and which each form with the associated shaft section, a rotor, each comprise at their outside a shaped surface 21 the shape of which is adapted to the shaped surfaces of the housing 8 or 9, and is composed of helical thread teeth which, in the example illustrated, correspond to a nine start helical screw thread, the housings 8, 9 each comprising 10 start helical screw threads. The shaped surfaces 21, 17 of the shaped members 19, 20 and of the associated housing 8, 9 engage in one another in the manner of helical screw teeth and jointly define a working chamber 22 ( (FIG. 2) which, with a multi-thread shaped surface construction comprises a corresponding number of passages following helical lines.

The shaped members 19 and 20 of resilient material are supported for limited radial displacement on the shaft 18 as diaphragm members. The shaft 18 is provided at and along its outside with ribs 23 distributed about its periphery and the shaped member 19 or 20 is provided at its inside with corresponding grooves 24 through which the member and the shaft are in mutual positive engagement. Such a multiple rib and groove connection ensures, regardless of radial displacement movements of the particular shaped body 19 or 20 with respect to the shaft 18, a constant uniformly distributed transmission of torque and excludes relative twisting movements and uncontrolled deformations in different regions or zones of the shaped member. The lateral faces of each rib 23 and of each associated groove 24 extend parallel to one another, so that the snug surface engagement between the side walls of the ribs and the grooves is retained during radial displacement movements of the shaped members 19 and 20.

The ribs 23 and the grooves 24 follow a helical path about the axis of the shaft 18 which is adapted to the path of the screw teeth. The helical path ensures a uniform taking up of axial forces appearing between the shaped members 19, 20 and the shaft 18.

The drive is divided into two drive sections 25, and 26 disposed co-axially one behind the other, each with a working chamber 22, by the housing 9, 8 with their shaped surfaces 17 and the associated shaped members 19 and 20 in turn comprising the shaped surfaces 21. The working chambers 22 have inlet ends 27, 28 disposed in spaced apart relation for the flushing medium supplied as working medium to the drive through the central bore section 6, and in particular opposite screw teeth of their shaped surfaces 17 and 21. The ribs 23 of the shaft 18 and the grooves 24 of the shaped bodies 19 and 20 in the two drive sections 25 and 26 have corresponding but oppositely turning helical paths, as can be seen in particular from FIG. 1*a*.

In the example illustrated, the shaft 18 is common to the two drive sections 25 and 26 and is made continuous. Instead of this, the two drive sections 25 and 26 may each have a separate component shaft associated with them, the component shafts being coupled to one another in the region between the inlet ends 27, 28 of the working chambers 22 of the two drive sections 25, 26.

Formed at the lower end of the shaft 18 is an external thread extension 29 to which an upper conical internal thread 30 of a connecting sleeve 31 is screwed. The sleeve 31 further comprises a lower conical internal thread 32 with which it is screwed to an upper external thread extension 33 of a universal joint shaft 34. The universal joint shaft 34 is screwed at its lower connecting end 35 by means of a thread connection 36 to the upper end of a bit drive shaft 38 disposed immediately above a drilling bit 37. For its connection to the drilling bit 37, the bit drive shaft 38 is provided at its lower end with an interal thread 39 with which it is screwed to an external thread extension 40 of the drilling bit 37.

The outer tube 16 screwed to the housing 8 of the lower drive section 26 is screwed at its lower end, by means of an internal thread 41 to an external thread extension 42 of an outer bearing housing 43 of a bearing or bearing block for the direct bit drive which, in the example illustrated, is formed by two tubular housing portions 45 and 46 screwed together at 44. An upper and lower radial bearing are provided at 47 and 48 while one or more axial thrust bearing 49 is or are disposed in an annular chamber between the bit drive shaft 38 and the bearing housing 43.

Figure 1B:
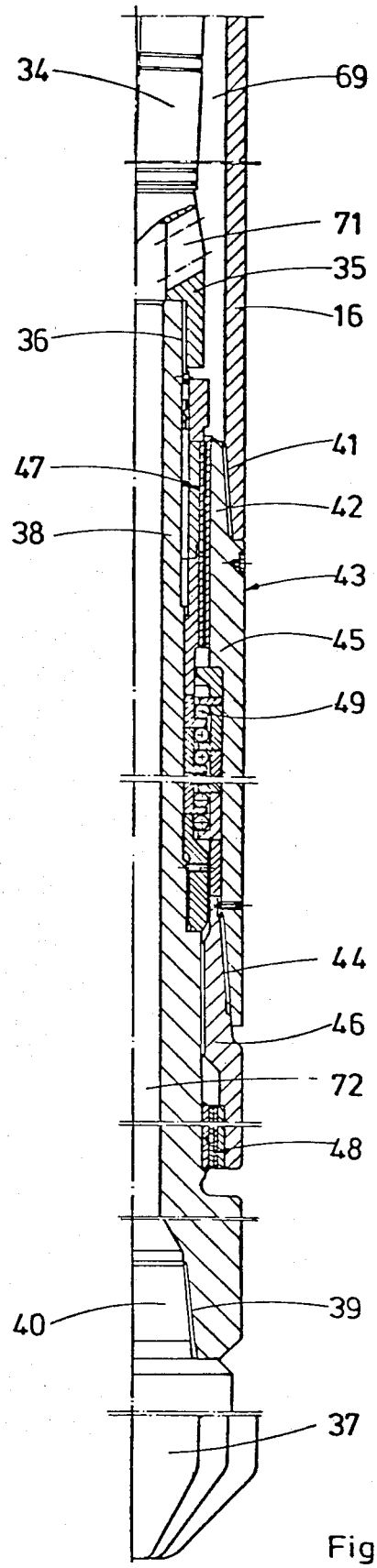
Figure 2:
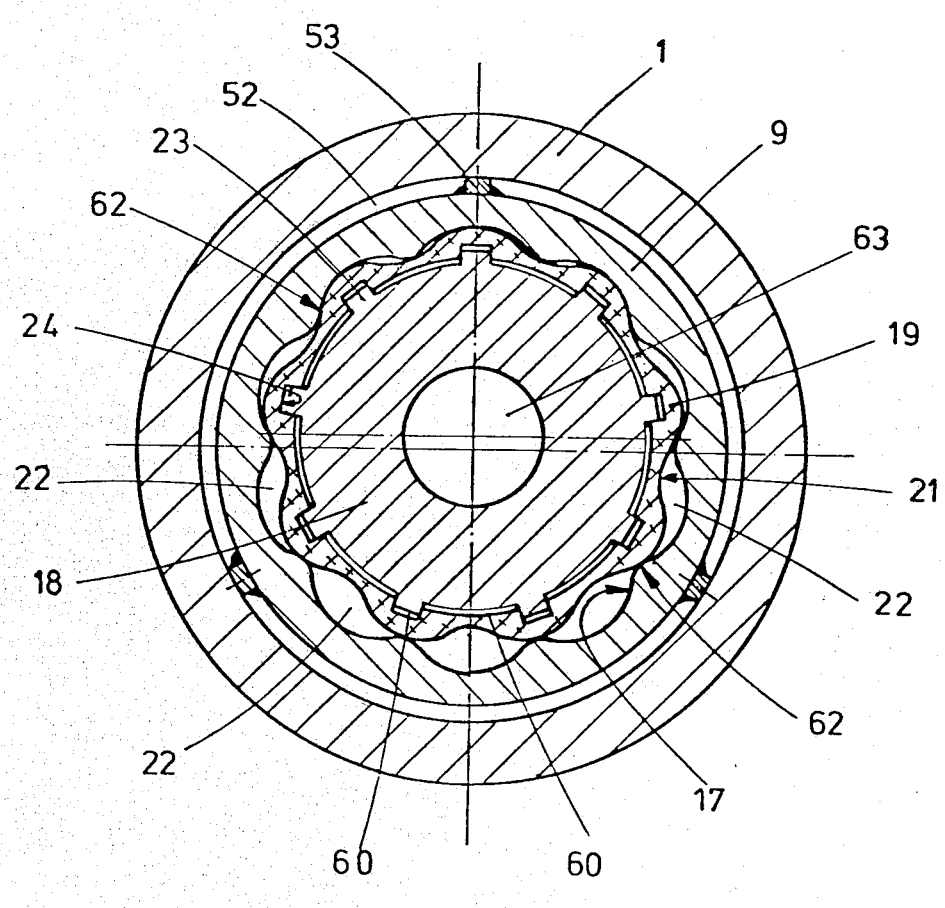
FIG. 2 shows a cross-section through the drive on the line II—II in FIG. 1*a*.

The inlet ends 27 and 28 of the working chambers 22 of the two drive sections 25 and 26 are adjacent to one another in the example shown in FIGS. 1*a*, 1*b* and 2, and between them there is formed an annular distributor chamber 50 for the working medium which is connected through a plurality of radial openings 51 in the sleeve region of the coupling 10 to an annular gap 52 which is formed between the outer tube 1 and the cylindrical wall of the housing 9 of the upper drive section 25, and the coupling 10 in alignment therewith. The housing 9 is centred in the annular chamber 52 by means of battens 53 welded onto its outer wall (FIG. 2). At the inside, the distributor chamber 50 is bounded by the shaft 18.

At its upper end, the resilient shaped member 19 of the upper drive section 25 is provided with a bush 54 of metal, preferably steel, which projects beyond the shaped member 19 at the end and is located on the shaft 18 by means of a nut 55. In the same manner, the lower end of the shaped member 20 is provided with a metal bush 56 against which the upper end of the connecting sleeve 31, comprising the conical internal thread 30, is screwed. In this manner the remote ends of the two shaped members 19 and 20 are each located on the shaft 18 and, furthermore, are sealed off from the shaft 18 by a packing ring 57 at each end.

At their adjacent ends 58 and 59, at which they bound the distributor chamber 50 for the working medium at the top and bottom respectively, the resilient shaped members 19, 20 of the two drive sections 25, 26 are not secured to the shaft 18 so that here the ends of gap-formed pressure chambers 60 open these chambers being formed between the shaft 18 and the shaped members 19, 20. These pressure chambers 60 extend substantially over the axial length of the shaped members 19, 20, and terminate at their opposite ends respectively at the bush 54 or 56 of the shaped members 19 and 20. With the helical path of the ribs 23 illustrated, the pressure chambers 60 in turn follow a helical path or with a construction in which the paths of the ribs are parallel, which is possible, the gaps are parallel but each form, on expansion of the two shaped members 29 and 20, a component of a coherent pressure chamber extending round the shaft 18, inside the two drive sections 25, 26.

The distributor chamber 50 is in communication, through the radial openings 51, the annular chamber 52 and the upper radial passage 61, with the central bore section 6, through which flushing medium is pumped as working medium at high pressure, downwards, in operation. Thus, in operation, the shaped members 19 and 20 of the two drive sections are acted upon by a deformation force which is directed radially outwards and is derived directly from the pressure of the working medium, which force tends to expand the shaped members and applies their outer shaped surface 21 with pressure against the shaped surface 17 of the two housings 8, 9. Through this action of the pressure derived from the working medium on the shaped members 19, 20 at the inside, the regions of the shaped surfaces 17 and 21 indicated at 62 in FIG. 2, which are in mutual engagement, bear against one another with a contract pressure which on the one hand always ensures reliable sealing and on the other hand reduces the wear which occurs to a minimum, regardless of the pressure at which the working medium is supplied, is already explained in detail in relation to the earlier proposal.

Extending through both drive sections 25 and 26 is a central continuous bore 63 in the shaft 18, which is in communication with the central bore section 6 through a central aperture in the annular flange 11, which forms a seating 64 for a ball valve 65 by means of which the central bore 63 can be shut off from the central bore section 6 for the drilling operation. In the drilling operation, therefore, the working medium flows, as already explained in connection with its action on the shaped members 19, 20, through the passages 61 and the annular chamber 52 into the distributor chamber 50 from which it flows in axially opposite directions through the working chambers 22 of the two drive sections 25, 26 imparting a rotary movement to the shaft 18 and experiencing a corresponding pressure drop.

After flowing through the working chambers 22 of the upper drive section 25, the working medium arrives, through a following chamber 66, bounded at the top by the annular flange 11 and the ball valve 65, in the central bore 63, through which it is returned downwards in the direction of the bit 37. The returned working medium emerges at the lower end of the shaft 18 from its central bore 63 and flows into an annular chamber 67 formed by the connecting sleeve 31, which it leaves through one or more radial openings 68 in the connecting sleeve 31, to unite with the component stream of working medium in the annular chamber 69 bounded by the outer tube 16, which stream flows through the working chamber 22 of the lower drive section 26 and in turn enters the annular chamber 69 through an annular chamber 70 between the external thread extension 14 and the connecting sleeve 31.

As a result of the pressure difference in the working medium between the distributor chamber 50 on the one hand and the chambers 66 and 67 on the other hand, an upwardly directed axial thrust force is applied to the rotor of the upper drive section 25, in operation, and a downwardly directed axial thrust force is applied to the rotor of the lower drive section 26, which cancel one another out insofar as the pressure drop of the working medium through the two drive sections 25, 26 is equal, which can be achieved in a simple manner, for example, by providing equal pressure-effective dimensions of the two drive sections 25 and 26 with the same pressure of working medium on its entry into the working chambers 22 of the two drive sections 25, 26 respectively, as is the case in the example being described. It is also conceivable to provide unequal pressure effective dimensions in the two drive sections 25, 26 and to supply the working medium with an appropriately increased or reduced pressure to one of the drive sections in order to achieve a balancing out of the axial thrust forces.

As a result of this equalisation or balancing out of the axial thrust forces in the drive, the universal joint shaft 34 and the axial thrust bearing 49 are relieved of axial thrust forces. This makes it possible to operate the drive at high pressure in order to achieve a high performance, such high pressure not otherwise being accommodatable by the universal joint shaft 34 acting as a thrust transmission member to apply thrust to the axial thrust bearing 49.

The concept of equalizing the thrust forces may be modified according to the invention by adopting a construction in which the two drive sections 25 and 26 are differently constructed so as to partially balance out their opposite axial thrust forces leaving a resulting axial residual thrust force directed towards the bit 37, by appropriate selection of the pressure-effective dimensions and/or of the pressure of the working medium in the drive section producing the downwardly directed axial thrust force towards the bit 37. If such an axial residual thrust force is transmitted to the axial thrust bearing 49 then in conjunction with the upwardly directed axial thrust force delivered by the bit 37 in drilling operation, a substantially load-free running of the axial thrust bearing or bearings can be achieved in the interests of further increasing their life, if the axial residual thrust force is dimensioned with a view to the axial thrust force to be applied by the bit.

In order to flush the bit 37 during a drilling operation, the working medium which has emerged from the two drive sections 25 and 26 and reached the annular chamber 69 is conveyed through one or more passages 71 into a central bore 72 in the bit drive shaft 38 leading to the bit 37.

The central bore 63 in the shaft 18 of the two drive sections 25 and 26 renders possible an ideal circulation of the flushing liquid while the bit 37 with its direct drive is lowered into a drillhole, in which case the ball valve 65 is not inserted so that there is a free passage from the central bore section 6 through the flange ring 11 into the central bore 63 for the flushing liquid which, as already described above with reference to the return of the working medium, flows out of the central bore 63 into the chamber 67 and out of this through the radial openings 68 into the annular chamber 69 and through the openings 71 and the central bore 72 to the bit 37. In this case the flushing liquid is in movement over the whole length of the tool, in an advantageous manner. During the circulation of the flushing liquid, the drive does not execute any rotation.

Once the tool has been lowered into the drill hole from above, the ball valve 65 is thrown in through the central bore 6 of the pipe string 5 and lands on the valve seating 64 in the flange ring 11. The drive is then ready for the drilling operation.

Figure 3:
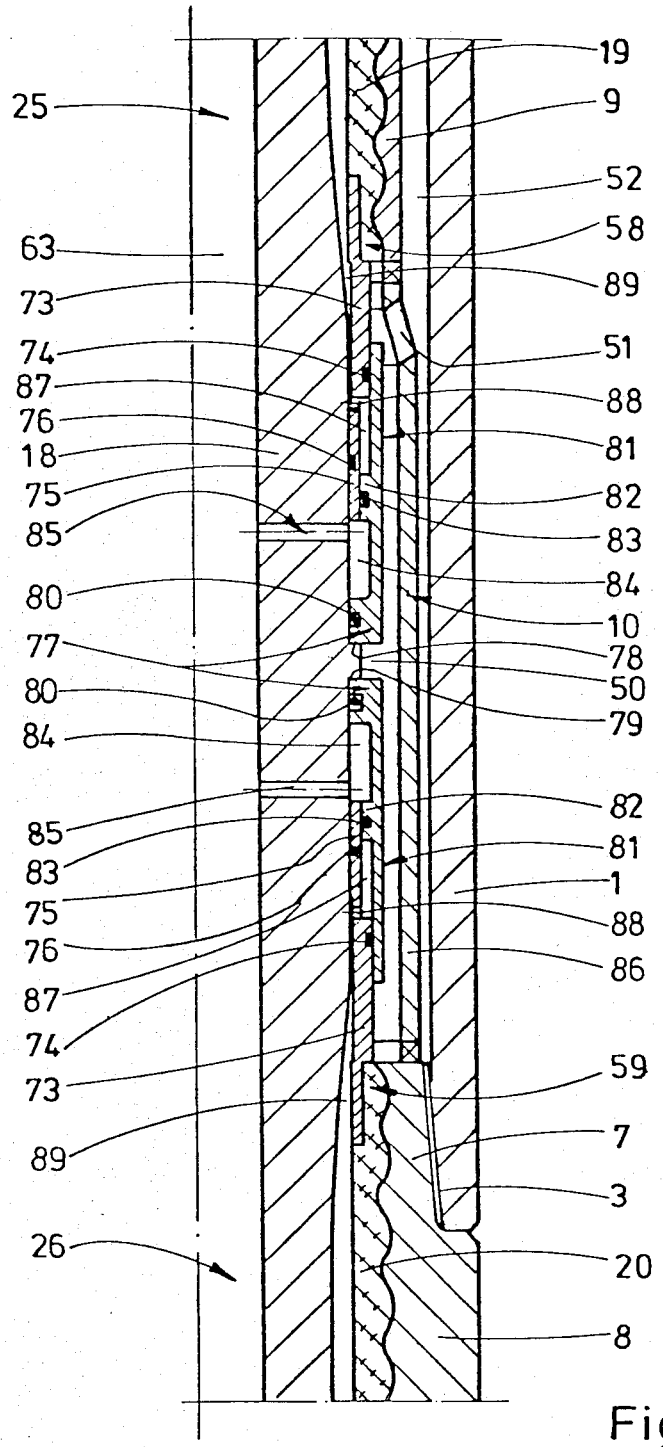
FIG. 3 shows a quarter longitudinal section through a second embodiment of a direct bit drive, the illustration being restricted to the central region of the drive.

Whereas, in the example shown in FIGS. 1*a*, 1*b* and 2, the shaped members 19, 20 of the two drive sections 25, 26 are acted upon from the inside through the pressure chambers 60 and their open connection to the working medium, alternatively the pressure chamber 60 between the resilient shaped members 19, 20 and the shaft 18 in each of the two drive sections 25, 26 can form a closed chamber filled with a separate pressure medium and comprising a pressure transmitter acted upon by the pressure of the working medium. FIG. 3 shows such an embodiment, wherein, in addition, the pressure transmitters are constructed in the form of pressure multipliers so as to increase the initial tension reached by the action of the separate pressure medium on the shaped members 19, 20 in a simple manner, as already explained by the earlier proposal for the same purpose.

The embodiment shown in FIG. 3 is particularly suitable with the division of the drive into two drive sections which are again designated in general by 25 and 26 in FIG. 3 and as such correspond to the drive sections 25 and 26 in the first embodiment described above. The same reference numerals are also used in FIG. 3 for further parts coinciding with parts described above, in connection with the first embodiment.

In the embodiment shown in FIG. 3, the shaped members 19 and 20 are each provided with a metal bush 73 which carries at its outer periphery a packing ring 74 and at its inner periphery, in an adjacent stepped region 75, a further packing ring 76.

Associated with each end 58, 59 of the shaped members is a piston sleeve 77 which surrounds the shaft 18 concentrically, the two piston sleeves 77 being supported at their adjacent ends on a shoulder 78 or 79 of the shaft 18 and being provided at the inner periphery of their piston portion with a packing ring 80. An apron 81 extending from each piston sleeve 77 to the end 58 or 59 of the shaped member is provided at the inside, substantially in its central region with an annular extension 82 which is sealed at its inner periphery by means of a packing ring 83 on the outer periphery of the stepped region 75 of the metal bush 73. With its free end, the apron 81 engages over the packing ring 74 at the outer periphery of the metal bush 73.

Each piston sleeve 77 surrounds with the region of its apron 81 adjacent to the piston portion, the annular extension 82 and the end edge of the stepped bush region 75, an annular chamber 84 which is connected via one or more radial bores 85 to the central bore 63 of the shaft 18. By means of the packing rings 80, the annular chambers 84 are each sealed off from the distributor chamber 50 to which the working medium is supplied, as in the first embodiment according to FIGS. 1*a*, 1*b* and 2, through the annular gap 52 via the bores 51 of a doubleacting coupling 10 comprising an elongated sleeve 86 in the present example, for the connection and location at an accurate angle of the housings 8 and 9 of the two drive sections 25 and 26. Then the working medium flows in opposite axial directions through the working chambers 22 of the two drive sections 25 and 26, and again the working medium which flows through a working chamber 22 of the upper drive section 25 and which is reduced in pressure, is returned through the central bore 63 of the shaft 18. The annular chambers 84 which are in communication with the central bore 63 through the bores 85 are, therefore, low-pressure chambers relative to the pressure of the working medium prevailing in the distributor chamber 50.

The free end region of each apron 81 of the piston sleeves 77 surrounds, in conjunction with the metal bushes 73, an annular chamber 87 which is filled with a separate pressure medium, for example oil, and these chambers 87 are connected through bores 88 and annular chambers 89 following on the ends 58 and 59 of the shaped members, with pressure chambers 60 (FIG. 2) between the shaft 18 and the shaped members 19 and 29 which are in turn filled with separate pressure medium, for example, oil. The chambers 87 are sealed off from the low pressure chambers 84 and the distributor chamber 50 by means of the packing rings 74, 76 and 83. The piston sleeves 77 comprise pressure surfaces which are exposed to a pressure difference between the hydrostatic pressure of the working medium in the inlet region of the drive section 25, 26, that is to say, the distributor chamber 50, and the pressure of the working medium reduced by flowing through the upper drive section 25. A pressure which is increased in relation to the pressure of the working medium prevailing in the distributor chamber 50 is produced in the oil chambers 87 through the annular extensions 82 so that the shaped members 19, 20 are acted upon at the inside with a correspondingly increased pressure.

Figure 4:
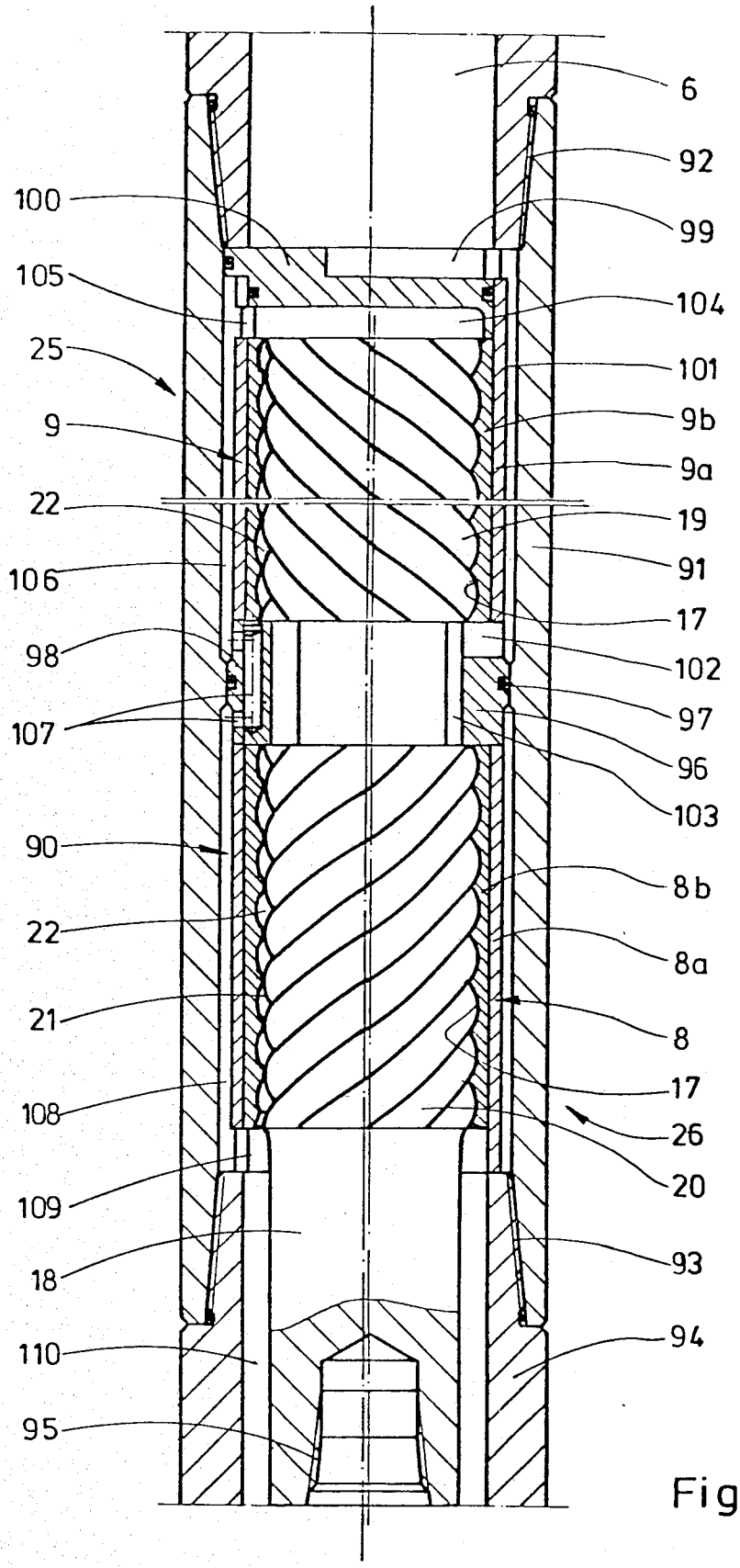
FIG. 4 shows a longitudinal section through a third embodiment of a direct bit drive according to the the invention in a region corresponding to FIG. 1*a*, the shaped member of the shaft being illustrated in elevation.

FIG. 4 shows an embodiment of a direct bit drive wherein the central bore 63 extending through the shaft 18, which is used in the examples of FIGS. 1 to 3 for the return of the working medium conveyed through the upper drive section 25 to the bit 37 is dispensed with. Instead, for this purpose, in the example of FIG. 4, a discharge device 90 is formed which extends along the outer periphery of the housings 8 and 9 of the two drive sections 25 and 26. The same reference numerals are again used below for parts which correspond with parts of the two embodiments described above.

In the example of FIG. 4, both drive sections 25 and 26 are surrounded by an outer tube 91 which is screwed at its upper end, at 92, in a sealing manner to the pipe string comprising the central bore section 6. At its lower end, the outer tube 91 is screwed, at 93, with a sealing action to a further outer tube 94 which receives, at 95, the universal joint shaft 34 connected to the shaft 18. The construction continuing further down is in accordance with that shown in FIG. 1*b*.

In the example shown in FIG. 4, the housings 8 and 9 of the two drive sections 26 and 25 are each formed from two tubular shells 8*a* and 8*b* or 9*a* and 9*b* which are rigidly connected to one another, and of which the tubular shells 8*b* and 9*b* comprise the shaped surfaces 17, and the externally and internally cylindrical tubular shells 8*a* and 9*a* serve to support the housings 8 and 9 at the ends remote from one another. The shaped surfaces again form in the mannner described above, and with the shaped surfaces 21 of the two shaped members 19 and 20, disposed with axial spacing on the shaft 18, the working chambers 22. At their adjacent ends, the two housings 8 and 9 are supported at the end on a connecting sleeve 96 which is provided with a packing ring 97 which bears in a sealing manner against the inner face of an annular extension 98 of the outer tube 91.

The device for supplying the working medium to the working chambers 22 of the two drive sections 25 and 26 comprises a radial passage 99 in a distributor disc 100 which is sealed in relation to the outer tube 91 and the housing 9 of the upper drive section 25. The radial passage 99 merges into a passage 101 which extends along the outer periphery of the upper housing 9 and which leads through a radial passage 102 through the connecting sleeve 96 into a distributor chamber 103 similar to the distributor chamber 50 in the two examples described above. Starting from the distributor chamber 103, the working medium again flows through the working chambers 22 of the two drive sections 25 and 26 in axially opposite directions. The pressure chambers 60 (FIG. 2) between the shaped members 19 and 20 and the shaft 18 are also acted upon by the working medium from the distributor chamber 103, and are closed, in a manner not illustrated, at their ends remote from one another.

After flowing through a working chamber 22 of the upper drive section 25, the working medium enters a chamber 104 which is constructed at the underside of the distributor disc 100 and from which it passes through one or more radial openings 105 into a return passage 106 which extends along an outer tubular shell 9*a* of the upper housing 9 and which is separated from the supply passage 101. The working medium returned from the upper drive section 25 passes through radial and axial bores 107, in communication with one another, in the wall of the connecting sleeve 96 into an annular gap 108 which in turn is in communication, below the lower drive section, through one or more radial bores 109, with an annular chamber 110 surrounded by the outer tube 94. The working medium conveyed through a working chamber 22 of the lower drive section 26 also leads into the annular chamber 110 so that, through the annular chamber 110, the working medium conveyed through both drive sections 25, 26 is conveyed to the drilling bit as already explained in detail with reference to the embodiment of FIGS. 1*a*, 1*b* and 2.

The abandonment of a central bore through the shaft 18 for the return of the working medium conveyed through a working chamber 22 of the upper drive section 25 does not mean that the shaft 18 has a solid cross-section in all cases in the drive region. The shaft 18 can nevertheless be at least partially constructed as a hollow sectional member inside the drive region, and the cavity can be used for installations, particularly pressure multipliers for amplifying the action of the working medium inside the shaped members 19 and 20.

Figure 5:
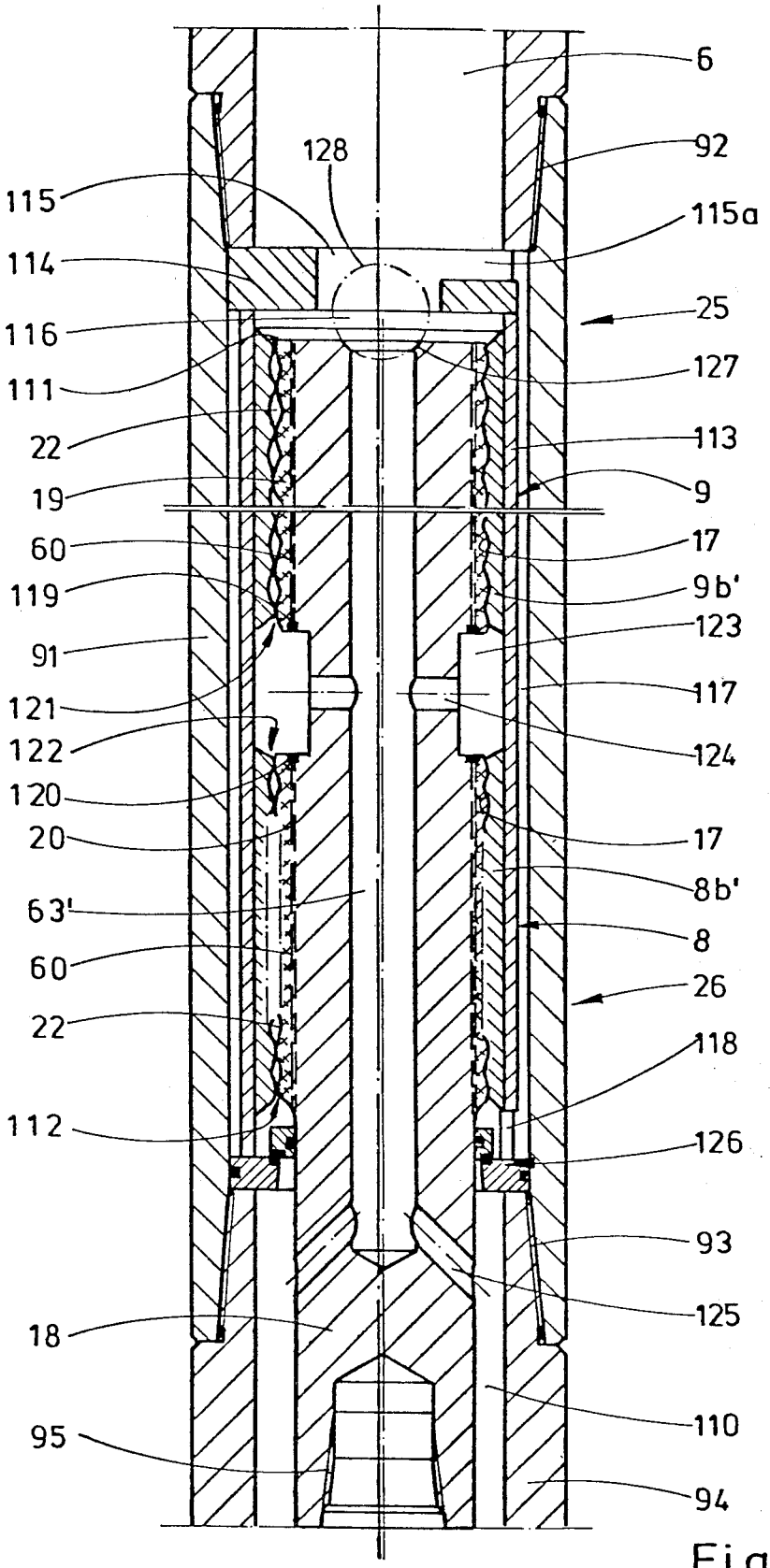
FIG. 5 shows a longitudinal section through a fourth embodiment of direct bit drive according to the invention, again in a region corresponding to FIG. 1*a*.

Whereas in the embodiments hitherto described, the inlet ends of the working chambers 22 of the upper and lower drive sections 25, 26 are always adjacent to one another, in the embodiment of FIG. 5, the remote ends 111 and 112 of the working chambers 22 form the inlet ends. The external construction of the drive corresponds substantially to that of the example of FIG. 4. Again, both drive sections 25 and 26 are surrounded by the outer tube 91 which is screwed at its upper end, at 92, to the pipe string comprising the central bore section 6, in a sealing manner, while at its lower end it is screwed in a sealing manner to the outer tube 94, at 93, which outer tube again receives the universal joint shaft connected to the shaft 18 at 95. In this embodiment, also, the construction continuing further down is in accordance with that shown in FIG. 1*b*.

The housings 8 and 9 are constructed in the form of two shells as in the example in FIG. 4, but in the example of FIG. 5 the outer tubular shell is formed from a continuous tube 113 with a cylindrical outer and inner face, which is common to the two drive sections 25, 26. The tubular shells 8*b*′ and 9*b*′ comprising the shaped surfaces 17 are rigidly connected, with mutual axial spacing, to the inner face of the tube 113. According to the axial longitudinal extent of the tubular shells 8*b*′ and 9*b*′, the resilient shaped members 19 and 20 are connected by means of the ribs 23 and grooves 24 (FIG. 2) to the shaft 18 to form the working chambers 22.

The supply of the working medium to the inlet ends 111 and 112 of the working chambers 22 is effected by means of a distributor ring 114 which is placed between the external threaded extension of the next upper tube of the pipe string comprising the central bore 6 and the outer tubular shell 113 of the housings 8 and 9 of the drive. Through the central aperture 115 of the distributor ring 114, working medium passes into a supply chamber 116 and from this directly through the inlet end 111 into a working chamber 22 of the upper drive section 25, through which it flows downwards. Through one or more radial passages 115*a* in the distributor ring 114, working medium further enters an annular gap 117 between the outer tube 91 and the tubular shell 113, which leads into a supply chamber 118 immediately below the lower drive section 26. From here, the working medium passes through the inlet end 112 into a working chamber 22 of the lower drive section 26 and flows through this chamber in an upward direction, counter to the direction of flow of the part of the working medium conveyed through a working chamber 22 of the upper drive section 25.

In a similar manner, the pressure chambers 60 between the shaft 18 and the shaped members 19 and 20 are acted upon by the working medium from the upper supply chamber 116 or from the lower supply chamber 118. The pressure chambers 60 are closed in a suitable manner in the region of the adjacent ends of the shaped members 19 and 20, as indicated at 119 and 120.

The adjacent outlet ends 121 and 122 of the working chambers 22 of the upper and lower drive sections 25, 26, which are disposed with mutual axial spacing, lead into a collecting chamber 123 for the working medium conveyed in opposite directions through the two working chambers 22, which collecting chamber 123 is formed between the two drive sections and is bounded on the inside by the shaft 18 and at the outside by the tubular shell 113. Through radial passages 124, the collecting chamber 123 is connected to the central bore 63' which, as in the case of the examples shown in FIGS. 1 to 3, extends through the two drive sections 25 and 26.

The working medium conveyed through the working chambers 22 of the upper drive section 25 and of the lower drive section 26 thus passes through the collecting chamber 123 and the radial passages 124 into the region of the central bore 63' extending downwards from these passages, which bore is provided, in its lower end region, with oblique passages 125 through which the returned working medium enters the annular chamber 110 and from there is supplied in the manner described to the drilling bit 37. The annular chamber 110 is sealed off from the chamber 118 by a sealing device 126.

The central bore 63' in its portion extending above the radial passages 124 to the end of the shaft here forms a seating 127 for a ball valve 128 corresponding to the ball valve 65 of the example described with reference to FIGS. 1*a*, 1*b* and 2. When the ball valve 128 is not on its seating 127, while the tool unit is being lowered into a drill hole, a circulation of the flushing liquid through the central bore 63' is assured and only on termination of the lowering of the tool unit is the ball valve 128 dropped through the pipe string so that it lands on its seating 127 and so makes the drive ready for operation as was explained above in detail with reference to the embodiment of FIGS. 1*a*, 1*b* and 2.

Although preferred forms of the invention have been described, it will be apparent to those having ordinary skill in this art that the invention is capable of still further modifications and variations and in this respect that the invention is limited only by the following claims.

What is claimed is:

1. In a direct bit drive for deep drilling tools of the kind comprising a housing having an inlet end and an outlet end, a rotor disposed in said housing for rotation therein and for limited radial enlargement but not for axial displacement, said rotor and said housing interengaging at surfaces shaped in the manner of helical teeth, said shaped surfaces jointly defining at least one helical working space for a liquid or gaseous working medium, one of said shaped surfaces being formed on a shaped member of resiliently deformable material, and bearing in regions which move axially, upon relative rotary movement between said housing and said rotor, under pressure, with a sealing action, against the other shaped surface, which is of rigid construction, said shaped member of resiliently deformable material being arranged to be acted upon by the pressure of a pressure medium in a pressure chamber with radially directed deformation forces which alter, depending on the pressure prevailing in the working medium at the inlet side of said housing, and wherein said rotor comprises a shaft which acts as a carrier for the shaped member of resiliently deformable material, said shaped member of resiliently deformable material being disposed on the shaft and being constructed in the form of a diaphragm member which is located at its two ends on the shaft and is freely displaceable radially in its intermediate region, relative to the shaft and which, at its inside, during its radial displacement movements, is in positive guiding engagement with formations of the shaft and can be acted upon by the pressure of a pressure medium in a pressure chamber formed between the shaped member of resiliently deformable material and the shaft with said radially directed deformation forces, the improvement that the drive is divided into two sections disposed end-to-end and co-axially in line each with a helical working space defined as aforesaid between surfaces shaped in the manner of helical teeth, the said helical working spaces following oppositely turning helical paths and being arranged for the flow therethrough of the working medium, in axially opposite directions, wherein the two drive sections are provided with a central continuous bore for the return flow of working medium conveyed through the helical working space of the upper drive section to the bit.

2. A direct bit drive as claimed in claim 1, wherein the two drive sections are constructed such that the axial thrust forces exerted by the sections, in operation of the drive, substantially balance one another.

3. A direct bit drive as claimed in claim 1, wherein the two drive sections are constructed such that axial thrust forces exerted by the sections, in operation of the drive, provide a residual axial thrust to oppose the thrust of the bit.

4. A direct bit drive as claimed in claim 1, wherein the two drive sections comprise a common continuous shaft.

5. A direct bit drive as claimed in claim 1, wherein the two drive sections comprise separate component shafts which are rigidly coupled together.

6. A direct bit drive as claimed in claim 1, wherein the two drive sections comprise separate component housings which are rigidly connected together.

7. A direct bit drive as claimed in claim 1, wherein the inlet ends of said helical working spaces of the drive sections are formed at the adjacent ends of the drive sections and a distributor chamber for the working medium is formed between said drive sections.

8. A direct bit drive as claimed in claim 7, wherein formed between the housing of the upper one of said drive sections and an outer tube surrounding the upper drive section is a feed device for the working medium to communicate a bore of a tube section of a pipe string with said distributor chamber.

9. A direct bit drive as claimed in claim 1, in which the central bore of the two drive sections is in communication, below the lower drive section, through one or more radial bores with an annular chamber communicating with the helical working space of the lower drive section and following that space in the direction of flow of the working medium, to convey the working medium from the two drive sections to the bit.

10. A direct bit drive as claimed in claim 9, wherein the central bore of the two drive sections is in aligned communication with the central bore of a pipe string supporting the drive and can be shut off from this by means of a ball valve.

11. A direct bit drive as claimed in claim 1, wherein the pressure chambers formed between the shaped members of resiliently deformable material and the shaft are acted upon by working medium in each of the two drive sections from the inlet ends of said drive sections.

12. A direct bit drive as claimed in claim 10, wherein said pressure chambers of the two drive sections have opposite helical teeth on their boundary surfaces.

13. A direct bit drive as claimed in claim 1, wherein the pressure chambers of the two drive sections formed between the shaped members of resiliently deformable material and the shaft each are closed, the chambers being filled with separate pressure medium, and associated with each chamber is a pressure transmitter arranged to be acted upon by the pressure of the working medium.

14. A direct bit drive as claimed in claim 13, wherein the pressure transmitters are in the form of pressure multipliers.

15. A direct bit drive as claimed in claim 13, wherein each pressure transmitter is formed by a piston sleeve concentric with and surrounding the shaft, which piston sleeve has pressure surfaces exposed to the pressure difference between the hydrostatic pressure of the working medium in the inlet region of the associated drive section and the pressure of the working medium emerging from the drive section.

16. A direct bit drive as claimed in claim 15, wherein the two piston sleeves are disposed with mutual axial spacing in an annular chamber which is bounded at the inside by the shaft and at the outside by a coupling sleeve which connects the housings of the two drive sections rigidly to one another, said annular chamber comprising at least one duct for supplying working medium to the inlet ends of said helical working spaces of the two drive sections.

17. A direct bit drive as claimed in claim 1, wherein a discharge device is formed which extends along the outer periphery of the housings of the two drive sections for returning working medium conveyed through the upper drive section to the bit.

18. A direct bit drive as claimed in claim 17, wherein the discharge device is in communication, below the lower drive section, through one or more radial bores, with an annular chamber communicating upstream with the helical working space of the lower drive section, said annular chamber being thus connected to convey working medium from the two drive sections to the bit.

19. A direct bit drive as claimed in claim 1, wherein the inlet ends of the helical working spaces of the two drive sections are remote from one another, and an upper supply chamber is provided to supply working medium to the upper drive section from a bore of a tube section of a pipe string and to the lower drive section through a lower supply chamber connectible to said bore through an annular gap formed between the two drive sections and an outer tube, and wherein a collecting chamber is formed at the adjacent outlet ends of the two drive sections, the collecting chamber being connected to a central bore extending through both drive sections, the bore communicating in turn with an annular chamber leading in the direction of the bit, to return working medium, conveyed through the two drive sections, to the bit.

20. A direct bit drive as claimed in claim 19, wherein the central bore of the two drive sections is in aligned communication with the central bore of a pipe string supporting the drive and can be shut off from this by means of a ball valve.

* * * * *

UNITED STATES PATENT OFFICE
CERTIFICATE OF CORRECTION

PATENT NO. : 4,265,323
DATED : May 5, 1981
INVENTOR(S) : Rainer Juergens

It is certified that error appears in the above-identified patent and that said Letters Patent are hereby corrected as shown below:

Column 4, line 63, "bearing" should read -- bearings --.

Column 5, line 62, "is" should read -- as --.

Signed and Sealed this

*Fourth* Day of *May 1982*

[SEAL]

*Attest:*

GERALD J. MOSSINGHOFF

*Attesting Officer*

*Commissioner of Patents and Trademarks*